US005442710A

United States Patent [19]

Komatsu

[11] Patent Number: 5,442,710

[45] Date of Patent: Aug. 15, 1995

[54] BODY-FELT SOUND UNIT AND VIBRATION TRANSMITTING METHOD THEREFOR

[75] Inventor: Akira Komatsu, Tokyo, Japan

[73] Assignee: Bodysonic Kabushiki Kaisha, Tokyo, Japan

[21] Appl. No.: 193,779

[22] Filed: Feb. 10, 1994

Related U.S. Application Data

[63] Continuation of Ser. No. 797,983, Nov. 26, 1991, abandoned.

[30] Foreign Application Priority Data

Nov. 30, 1990 [JP] Japan ..... 2-340766

[51] Int. Cl.[6] ..... H04R 5/02

[52] U.S. Cl. ..... 381/24; 601/47; 601/49; 601/51; 601/58

[58] Field of Search ..... 601/46, 47, 48, 49, 601/56, 57, 58, 51; 381/154, 24, 203, 162

[56] References Cited

U.S. PATENT DOCUMENTS

| | | | |
|---|---|---|---|
| 2,833,276 | 5/1958 | Murphy | 601/58 |
| 3,113,633 | 12/1963 | Eberhardt et al. | 381/24 |
| 3,925,627 | 12/1975 | Ashworth | 381/152 |
| 4,064,376 | 12/1977 | Yamada | 601/47 |
| 4,357,498 | 11/1982 | Tsuchiya et al. | 381/203 |
| 4,385,210 | 5/1983 | Marquiss | 381/203 |
| 4,430,992 | 2/1984 | Christ | 128/33 |
| 4,620,334 | 11/1986 | Robinson | 128/33 |
| 4,720,867 | 1/1988 | Imai et al. | 381/152 |
| 4,779,615 | 10/1988 | Frazier | 601/47 |
| 4,785,797 | 11/1988 | Cuervo | 128/33 |
| 4,860,733 | 8/1989 | Parker, Jr. | 128/33 |
| 4,914,750 | 4/1990 | Lawson | 381/203 |

*Primary Examiner*—Forester W. Isen
*Attorney, Agent, or Firm*—Oliff & Berridge

[57] ABSTRACT

A body-felt sound unit having a vibration transmitting member imbedded in a human body support member, for example, a chair, a bed, etc., and an electro-mechanical vibration transducer attached to the vibration transmitting member, the transducer generating mechanical vibration on receipt of a low-frequency current, thereby transmitting the vibration to the human body. The vibration transmitting member comprises a flat plate- or net-shaped member of a relatively large area, and the electro-mechanical vibration transducer is attached to the vibration transmitting member such that the direction of vibration generated from the transducer coincides with the direction of the width of the vibration transmitting member so as to transmit transverse vibration to the vibration transmitting member. Even if the vibration transmitting member is thin, the apparent rigidity becomes high, so that the transmission of vibration is made effectively.

5 Claims, 5 Drawing Sheets

BODY-FELT SOUND UNIT AND VIBRATION TRANSMITTING METHOD THEREFOR

This is a Continuation of application Ser. No. 07/797,983 filed Nov. 26, 1991, now abandoned.

BACKGROUND OF THE INVENTION

1. Field of the Invention

The present invention relates to a body-felt vibration unit wherein a sound signal from a sound device is converted into vibration through an electro-mechanical vibration transducer to vibrate a vibration transmitting member installed on a thing for the human body to be placed on (hereinafter referred to as "human body support member"), for example, a chair, a bed, etc., thereby giving the user a bodily sensation of vibration. The present invention also relates to a method of transmitting the vibration in the above-described body-felt sound unit.

2. Prior Art

The present inventors have been conducting studies, for a long time, of body-felt sound unit that converts a sound signal received from a sound device or the like into mechanical vibration and allows the user to receive this vibration by his/her body, together with sound from a speaker or a head receiver, and we have already obtained many patent rights and utility model rights (for example, see Japanese Patent Publication Nos. 58-2517, 57-9272, and 58-9640, and Japanese Utility Model Publication Nos. 64-6622, and 58-4316). All the sensible vibration units disclosed in these publications have a structure in which an electro-mechanical vibration transducer is imbedded in or attached to a human body support member, for example, a chair, and vibration that is generated from the electro-mechanical vibration transducer is applied to the user's body through a vibration transmitting member or the human body support member.

This type of body-felt vibration unit is designed to allow the user to feel low bass frequencies generated from an electric signal in the bass region by the vibration of the eardrum and the bodily-sensation of vibration with a view to relaxing the user mainly through the appreciation of music with an intensified feeling of being at a live performance, or through the bodily sensation of vibration by the vibration signal alone,, without music. Accordingly, body-felt vibration units, which have been proved to be effective medically or psychiatrically, are used in a wide field of application.

As to the electro-mechanical vibration transducer (hereinafter referred to as simply "transducer") that is employed in the above-described body-felt vibration unit, a basic type of transducer has already been disclosed in U.S. Pat. No. 4,750,208.

Transducers which are usable for the body-felt vibration unit include an electrodynamic type of transducer and an electromagnetic type of transducer, both of which are arranged such that a vibrating part thereof vibrates in accordance with the intensity of the input signal to cause a vibration transmitting member, which is imbedded in or attached to a human body support member, to vibrate in the direction of vibration of the vibrating part, so that the vibration is transmitted to the user's body in a direction normal to it. This vibration will hereinafter be referred to as "longitudinal vibration".

The above-mentioned Japanese Patent Publication No. 58-2517 deals with an invention relating to a cushioning member that is to be interposed between a vibration transmitting member and the human body, and gives a description of the feeling that the user has when sitting on the chair, for example, as a human body support member, and the uniform dispersion of the vibration that is applied to the user's body in a direction normal to it. Japanese Patent Publication No. 57-9272 also discloses a combination of a vibrating plate and a cushioning member, but this invention aims at efficiently transmitting vibration to the user's body. The inventions in the other three publications described above disclose a means for reducing the size and weight of the transducer and a method of attaching the transducer to a human body support member. All of these three inventions relate to a device to allow the user's body to receive efficiently a sound signal in the low-frequency region from a vibration transmitting member.

If a body-felt vibration unit is arranged such that vibration that is generated from a transducer is transmitted to the user's body through a human body support member, as described above, it is likely that all or part of the user's weight will be applied to the transducer, as a matter of course. It is therefore necessary to improve the human body support member or the transducer so that the transducer will not be damaged even if the user's weight is applied thereto. In other words, a reinforcing member or the like is needed in order to prevent application of unnecessary external force to the transducer, resulting in problems, such as an increase in the overall size of the apparatus.

Further, from the viewpoint of the structural association of the transducer with the vibrating plate, disclosed in the above-described publications, the vibration transmitting plate that vibrates sympathetically to the vibration generated from the transducer must have a plate-shaped configuration and the plate-shaped member must be vibrated in the direction of the thickness thereof in order to attain the purpose thereof. In this case, the arrangement is such that, no matter where the transducer is imbedded in the human body support member, the vibration from the vibrating plate is transmitted to the user's body in a direction normal to it. Accordingly, the user's weight forms longitudinal vibration that is counter to the direction of vibration of the vibration transmitting member.

In addition, since the transmission of vibration from the transducer to the vibration transmitting member is effected convergently, it is necessary in order to transmit uniform vibration to the whole vibration transmitting member to increase the thickness of the vibration transmitting member itself or to take into consideration the necessity of a structure in which transducers are dispersedly disposed.

SUMMARY OF THE INVENTION

In view of the above-described problems of the prior art, it is an object of the present invention to provide a body-felt vibration unit wherein a flat plate- or net-shaped vibration transmitting member of a relatively large area is attached to a transducer in such a manner that the vibration transmitting member is vibrated in the direction of the width thereof (the vibration being hereinafter referred to as "transverse vibration").

It is another object of the present invention to provide a vibration transmitting method for use in a body-felt vibration unit in which a vibration transmitting member is vibrated by a transducer, wherein the vibration transmitting member comprises a flat plate- or net-shaped member of a relatively large area which faces the user's body across a cushioning member, and vibration that is generated from the transducer is transmitted to the vibration transmitting member in the direction of the width of the latter.

The vibration transmitting mechanism in the plate-shaped vibration transmitting member will be explained below.

Assuming that vibration from the transducer is applied to the center of a flat plate-shaped member of a predetermined large area, the longitudinal vibration is transmitted to the periphery of the plate-shaped member from the transducer as the center of vibration. At this time, the intensity of the vibration transmitted attenuates as the distance from the center increases. The degree of attenuation is inversely proportional to the increase in the hardness and stiffness of the plate-shaped member.

Accordingly, if the transducer is provided in the peripheral portion of the vibration transmitting member so that the user's weight will not be applied thereto, the longitudinal vibration attenuates markedly as the distance from the transducer increases, so that the desired effect cannot be obtained.

However, it has been confirmed experimentally that, if vibration is applied from the edge portion of a plate-shaped member in the direction of the width of the plate-shaped member, that is, in a direction perpendicular to the direction of the above-described longitudinal vibration, the above-described attenuation becomes extremely small. This phenomenon is attributable to the fact that, if a vibrating medium is continuously present in the direction of the transverse vibration applied thereto, the transmission of the vibration is effected efficiently in proportion to the density and hardness of the medium.

Considering that the vibration transmitting member of the present invention is not always used in the form of a flat plate, it will be understood that application of transverse vibration by making use of the above-described phenomenon is extremely effective from the viewpoint of the object of the present invention.

DETAILED EXPLANATION OF THE INVENTION

One embodiment of the present invention will be explained below with reference to the accompanying drawings.

Figure 1:
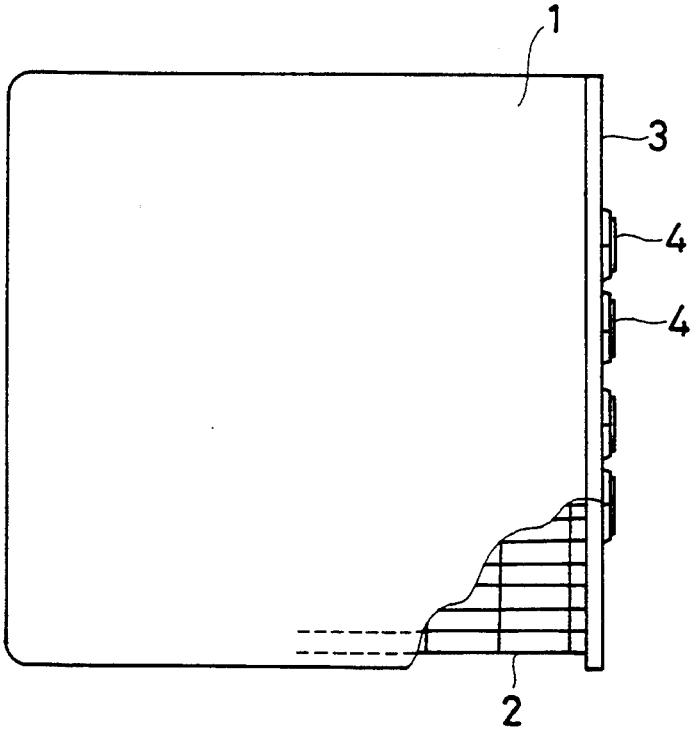
FIG. 1 is partly-cutaway plan view of one embodiment of the present invention.
Figure 2:
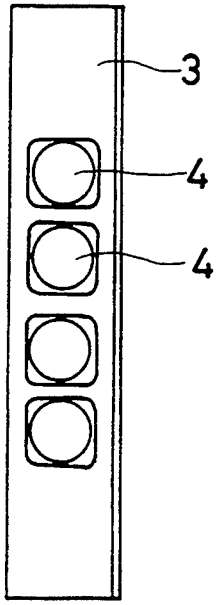
FIG. 2 is a front view of the embodiment shown in FIG. 1 as viewed from the right-hand side thereof.
Figure 3:
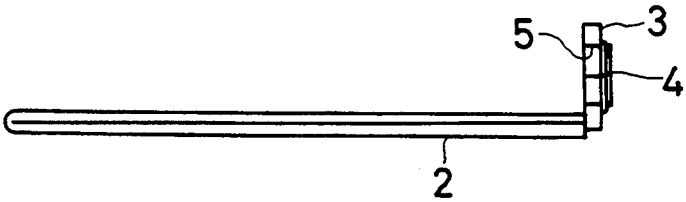
FIG. 3 is a sectional view of the embodiment shown in FIG. 1.
Figure 5:
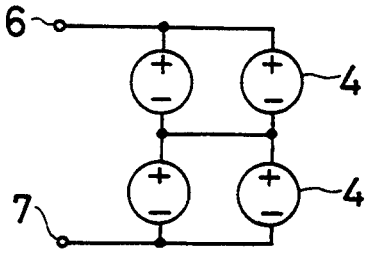
FIG. 5 is a circuit diagram showing one example of the connection of converters.
Figure 4:
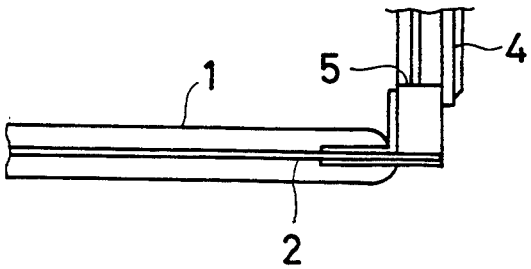
FIG. 4 is an enlarged sectional view of an essential part of the arrangement shown in FIG. 3.

Referring to FIG. 1, a vibrating mat 1 has a vibration transmitting member 2 provided therein. The vibrating mat 1 is a bag-shaped member comprising soft cloth and urethane foam with a thickness of 25 mm and having the vibration transmitting member 2 wrapped therein. The vibration transmitting member 2 comprises a plastic net with a thread diameter of 3.5 mm and has a proper hardness and elasticity. A vibrating plate 3 is attached to one end of the vibration transmitting member 2 in such a manner as to be erect at right angles to the direction in which the net extends. Four transducers 4 with a structure described later are attached to the vibrating plate 3. The transducers 4 are attached in such a manner that the transducers 4 are fitted into respective bores 5 provided in the vibrating plate 3 and secured by means, for example, bolts (not shown), as shown in FIGS. 3 and 4. The transducers 4 are preferably connected in such a manner that two pairs of series-connected transducers are connected in parallel to input terminals 6 and 7, as shown exemplarily in FIG. 5.

If a sound signal having its low frequency component cut off is input to the transducers 4 attached to the vibrating plate 3 in this way, vibration that is generated from the transducers 4 is transmitted to the vibration transmitting member 2 through the vibrating plate 3. More specifically, transverse vibration is applied to the vibration transmitting member 2 from the end thereof to which the vibrating plate 3 is attached. The reason why the vibrating plate 3 is interposed between the transducers 4 and the vibration transmitting member 2 is to produce uniform vibration by transmitting the vibration of the transducers 4 as a vibration source to the relatively thick vibrating plate 3 so as to induce longitudinal vibration and by disposing the vibrating plate 3 over the entire edge portion of the plate-shaped vibration transmitting member 2. In principle, it is only necessary that the direction of vibration generated from the transducers 4 is coincident with the direction of the width of the vibration transmitting member 2. In the process of transmitting the vibration to the other end of the vibration transmitting member 2, the vibration is partly converted to vibration in the transverse direction (i.e., the direction intersecting the vibration transmitting member 2), but the user 9 who lies on the vibrating mat 1 feels mainly the transverse vibration.

Figure 6:
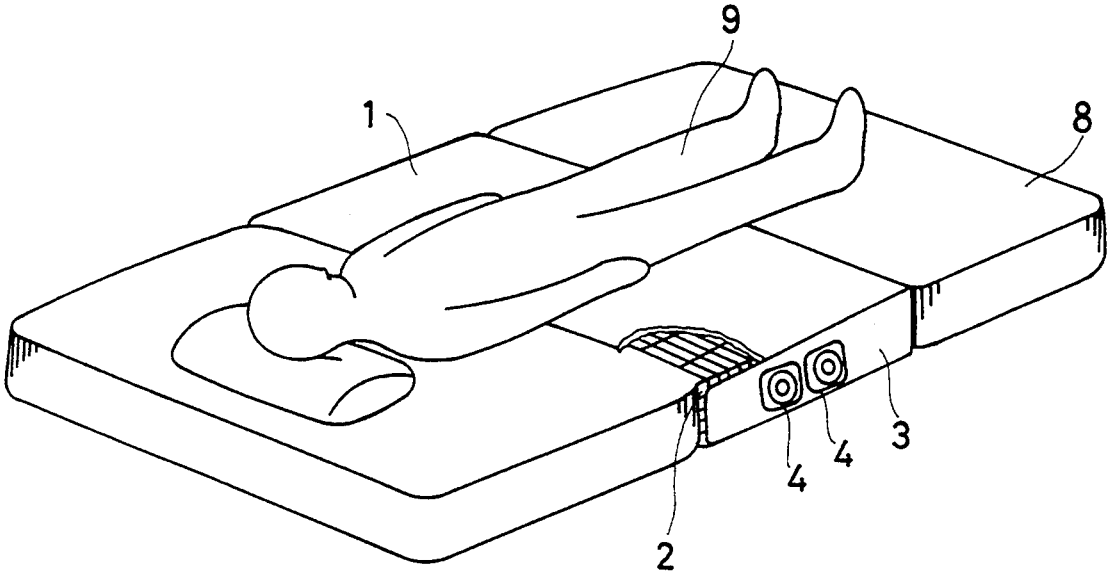
FIG. 6 is a perspective view of another embodiment of the present invention which is in actual use.
Figure 7:
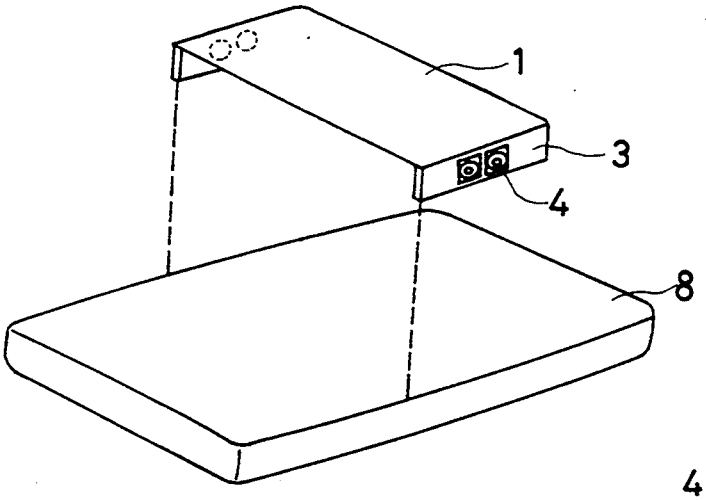
FIG. 7 is a perspective view showing the way in which the embodiment shown in FIG. 6 is assembled.
Figure 8:
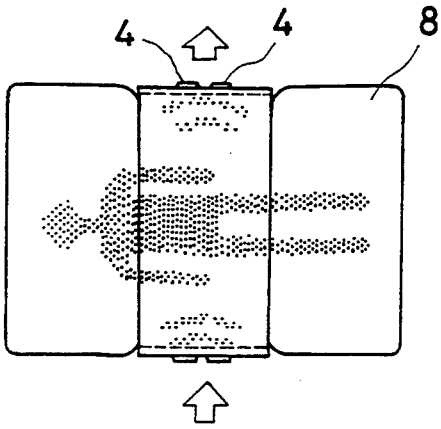
FIG. 8 is a plan view of the embodiment shown in FIG. 6, illustrating the direction of vibration.
Figure 10:
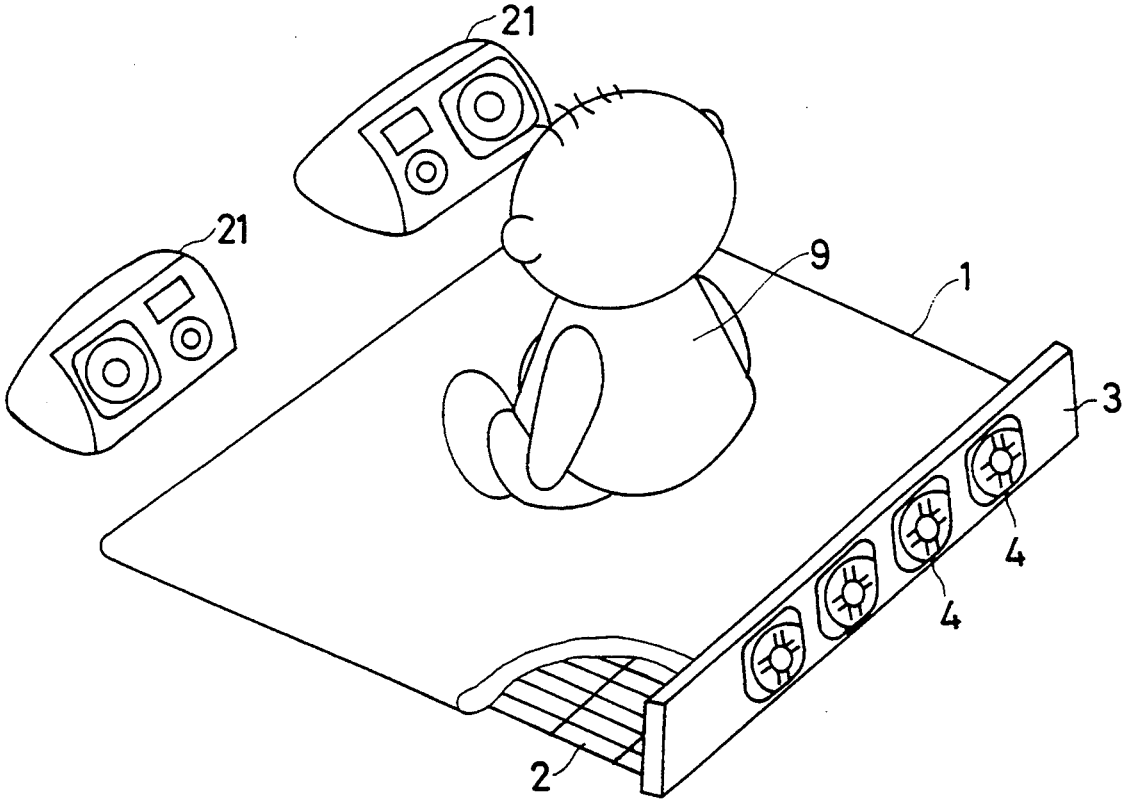
FIG. 10 is a perspective view of still another embodiment of the present invention.

FIG. 6 shows another embodiment of the present invention, in which the body-felt vibration unit of the present invention is formed in the shape of a U and this is put on the center of a ready-made mattress 8 from above it, as shown in FIG. 7. In this state, vibrations that are generated from the transducers 4 are transmitted (in the form of transverse vibration) in the direction of the width of the mattress 8, as shown in FIG. 8. If the transducers 4, which are disposed at the left and right sides of the mattress 8 to face opposite to each other, are arranged to be opposite in polarity to each other, the vibrations exhibit synergistic effect in push-pull manner, as shown in FIG. 8.

Figure 9:
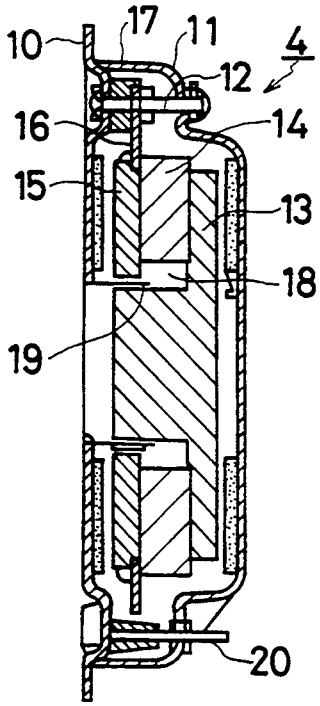
FIG. 9 is a sectional view of one example of transducers.
Figure 11:
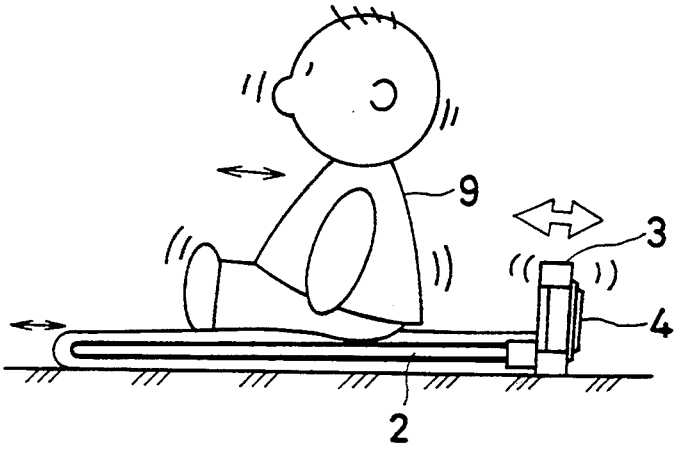
FIG. 11 is a sectional view of the embodiment shown in FIG. 10 which is in actual use.

FIG. 9 shows one example of electrical conductive transducers 4. In this figure, reference numeral 10 denotes a base plate having its outer periphery formed into a flange, and 11 a cover. The cover 11 is secured to the base plate 10 by a bolt 12. A structure such as that described below is accommodated in a casing body that comprises the base plate 10 and the cover 11, thereby forming a transducer 4.

As shown in FIG. 9, a yoke 13 has a T-shaped cross-sectional configuration. A ring-shaped magnet 14 is attached to the outer peripheral portion of the yoke 13, and a top plate 15 is provided on the outer side of the magnet 14. These members are supported by the bolt 12 through a ring spring 16 serving as a damper. Reference numeral 17 denotes a spacer. With the above-described structure, a magnetic air gap 18 is formed between the inner periphery of the top plate 15, one surface of which is in contact with the magnet 14, and the projecting portion of the yoke 13. A coil 19 is provided in the air gap 18 such that a low-frequency current is supplied to the coil 19 from a sound device (not shown) through a cord 20.

The transducer 4, arranged as decribed above, is attached to the vibrating plate 3 and supplied with a sound signal after it has been subjected to signal processing. More specifically, when the coil 19 receives a low-frequency current from a sound device (not shown), which has been subjected to signal processing, the coil 19 is caused to vibrate with respect to the integral structure comprising the yoke 13, the magnet 14 and the top plate 15 by the magnetic interference between the coil 19 and the magnet 14. In consequence, the vibrating plate 3 having the transducer 4 attached thereto longitudinally vibrates in the direction of the thickness thereof, so that the vibration transmitting member 2 vibrates transversely. The vibration allows the user 9 on the vibrating mat 1 to feel a bodily sensation of vibration.

Figure 12:
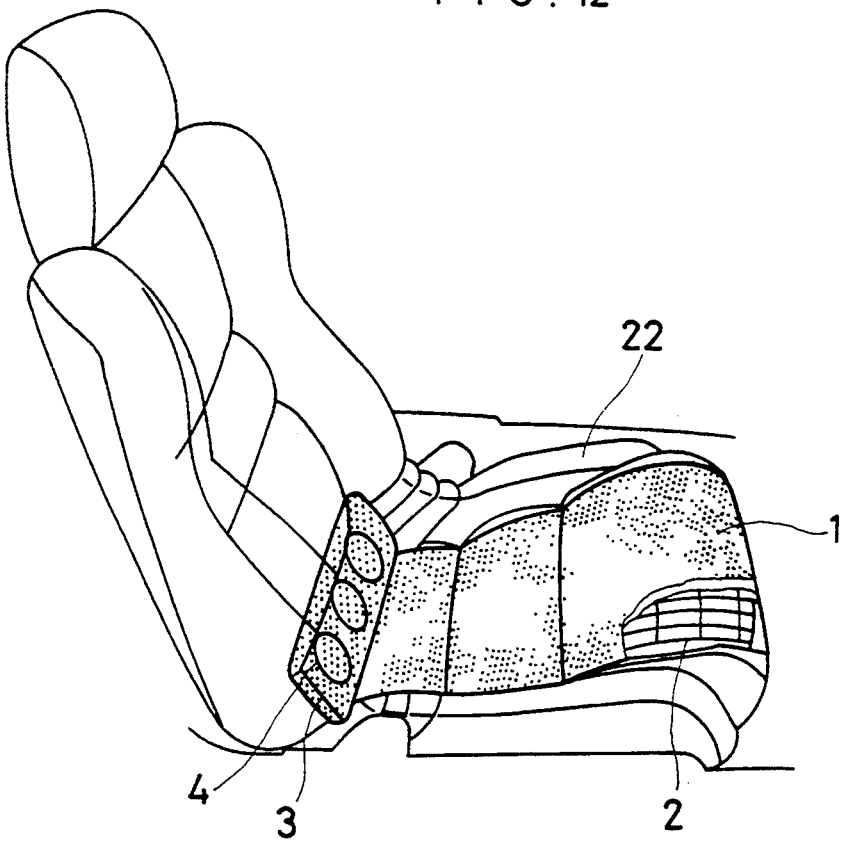
FIG. 12 is a perspective view of a further embodiment of the present invention.
Figure 13:
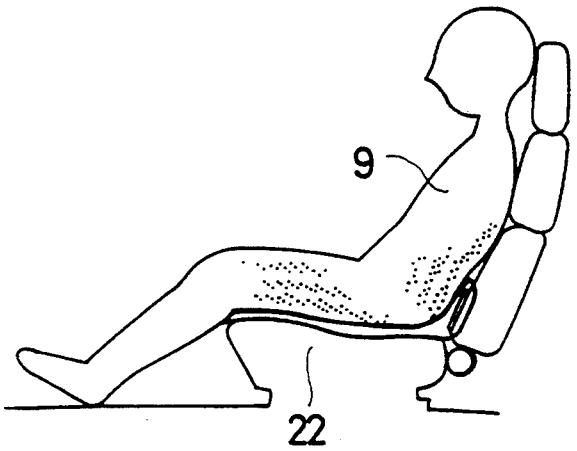
FIG. 13 is a side view of the embodiment shown in FIG. 12 which is in actual use.

FIGS. 12 and 13 show a further embodiment of the present invention, in which the invention is applied to a seat 22 for an automobile. In this case, the vibrating mat 1 is curved in conformity with the seat 22, but the basic arrangement thereof is the same as that shown in FIG. 1.

Figure 14:
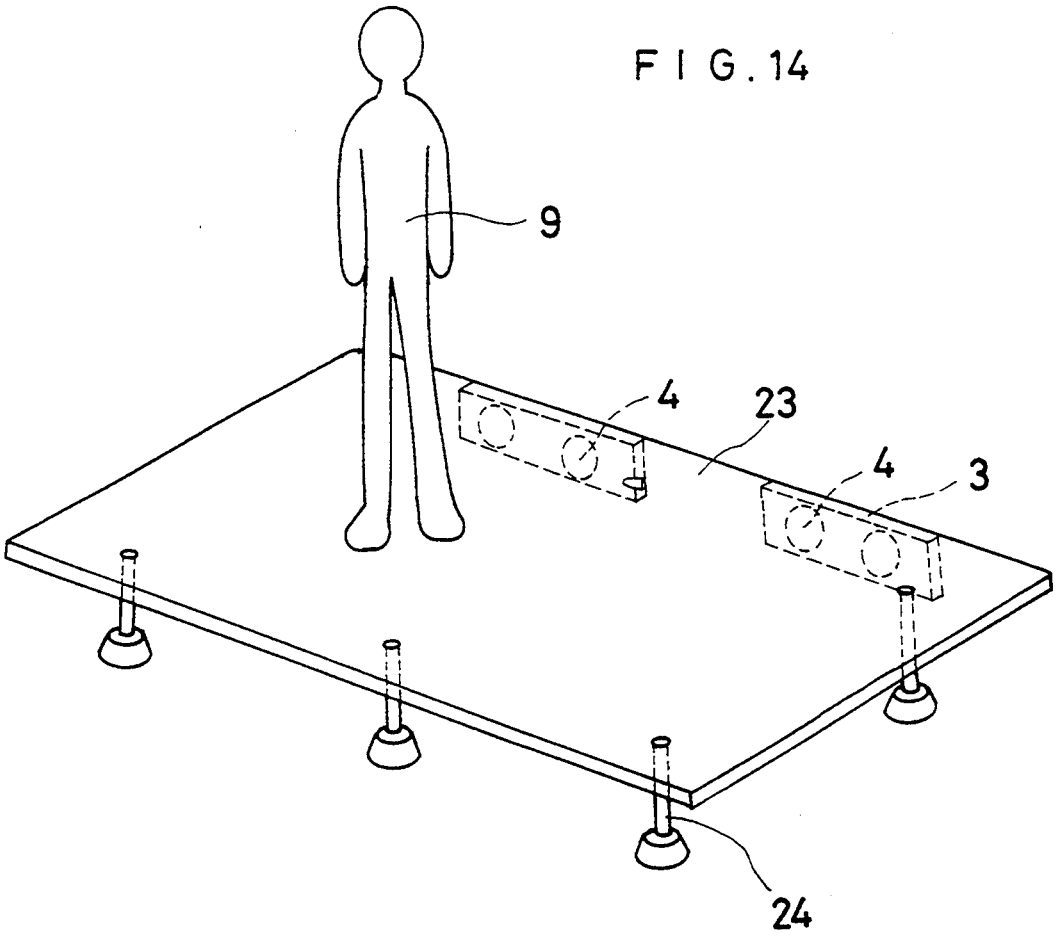
FIG. 14 is a perspective view of a still further embodiment of the present invention.
Figure 15:
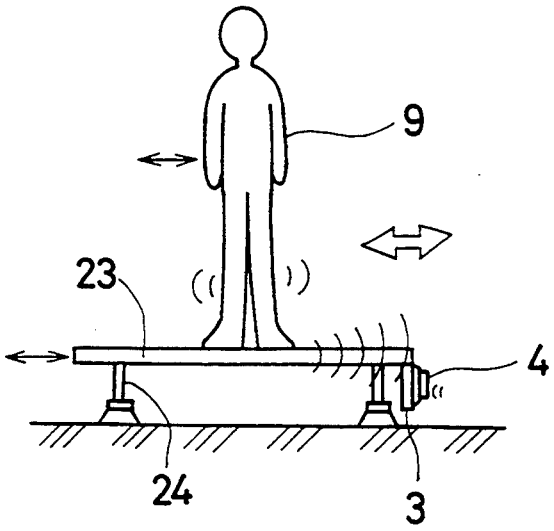
FIG. 15 is a side view of the embodiment shown in FIG. 14 which is in actual use.

FIGS. 14 and 15 show a still further embodiment of the present invention, in which the invention is applied to a floor 23 for aerobics in a physical fitness gym. Reference numeral 24 denotes supports. To cause the floor 23 to vibrate transversely in this case, the vibrating plates 3 may be disposed not only at the positions shown in the figure but also at the center or other positions of the floor 23. In this embodiment, when the apparatus is activated, the floor 23 vibrates transversely, as shown by the arrows in FIG. 15.

Although the foregoing embodiments use the transducers 4 having an internal structure such as that shown in FIG. 9, it should be noted that the present invention is not necessarily limited thereto and that transducers 4 with a structure different from the above may also be employed. The essential thing is to use transducers 4 which can generate a vibration corresponding to an input signal which varies incessantly in both frequency and amplitude, such as a musical signal. The low-frequency current that is applied to the transducers 4 is preferably below about 150 Hz from the viewpoint of the vibration efficiency, but it is preferable to determine a proper cut-off frequency in conformity with the material of the vibration transmitting member 2, the configuration of the vibrating mat 1, etc.

As to the vibration transmitting member 2, it is also possible to employ a film- or bar-shaped vibration transmitting member made of a plastics or other material, in addition to the plastic net employed in the described embodiments.

As has been described above, according to the present invention, transverse vibration is applied to a plate- or net-shaped vibration transmitting member, and therefore, even if the vibration transmitting member is thin, the apparent rigidity becomes high, so that the transmission of vibration is made effectively. As a result, the following specific advantages are obtained:

(1) The thickness of the unit can be reduced, so that the user can sit on it without discomfort.

(2) Since the transducers can be arranged such that the user will not lie thereon, there is no probability of the transducers being destroyed. It was confirmed experimentally that satisfactory results were obtained also when a chair or the like was placed on the unit.

(3) The unit can be formed in a soft structure, on the whole, and can be used as a rug which is suitable for either of Japanese- and Western-style rooms.

(4) Because of the transverse vibration system, there is less acoustic radiation (i.e., beat note) from the vibation transmitting member by the woofer effect. The conventional longitudinal vibration system suffers from the disadvantage that, as the area of vibration of a floor or a rug increases, the acoustic radiation efficiency of bass increases and the acoustic radiation increases, whereas the present invention that adopts transverse vibration is free from such a problem.

(5) The vibration transmission efficiency is high. Since the vibrating system can be made light in weight and superior in the vibration transmission, a product of high vibration efficiency can be obtained. More specifically, the conventional longitudinal vibration system involves the problem that, if the vibration transmitting member is made light in weight, it becomes soft, resulting in a lowering in the vibration transmission efficiency. However, in the transverse vibration system according to the present invention, the material is vibrated transversely, and therefore, even if the material is a net-shaped light plastic material, as shown in the embodiments, the stiffness in the direction of vibration can be maintained at a high level equivalently, so that the vibration transmission efficiency can be maintained at a high level.

(6) Comfortable vibration can be obtained. The conventional longitudinal vibration system involves the problem that the user may have a feeling of being thrust up excessively, depending upon the kind of sound, whereas the transverse vibration system has less probability that such a problem will occur.

(7) It is possible to cope with a vibration transmitting member with a wide area by driving it from both sides thereof. In such a case, transducers which are disposed at the two sides of the vibration transmitting member are arranged to be opposite in driving polarity to each other. When the area of the vibration transmitting member employed is wider than the above, it may be driven from four directions.

(8) It is possible to form an even more convenient unitized commodity by attaching a speaker or/and an amplifier to a portion of the vibrating plate where the transducers are attached.

What is claimed is:

1. A body-felt vibration unit having a vibration transmitting member imbedded in a human body support member, and an electro-mechanical vibration transducer attached to a vibration receiving plate fixed to said vibration transmitting member, said transducer generating constantly varying arbitrary mechanical vibration on receipt of a constantly varying arbitrary low-frequency current, thereby transmitting varying vibration to a human body on the body support member, said electro-mechanical vibration transducer and said vibration receiving plate being disposed substantially perpendicular to said vibration transmitting member, wherein vibration generated from said transducer is transmitted along an extending direction of said vibration receiving plate, thereby transmitting transverse vibration to said vibration transmitting member.

2. A body-felt vibration unit according to claim 1, wherein said electro-mechanical vibration transducer and said vibration receiving plate are attached to an edge portion of said vibration transmitting member.

3. A body-felt vibration unit according to claim 1, further comprising a vibrating member interposed between said vibration transmitting member and a vibrating portion of said electro-mechanical vibration transducer.

4. A body-felt vibration transmitting method in which the vibration of an electro-mechanical vibration transducer that vibrates on receipt of a low-frequency current signal is transmitted to a vibration receiving plate fixed to a plate-shaped vibration transmitting member imbedded in a human body support member, thereby transmitting the vibration to the human body, the method comprising:

arranging said electro-mechanical vibration transducer and said vibration receiving plate to be substantially perpendicular to said vibration transmitting member; and mechanically applying the vibration of said electro-mechanical vibration transducer to said plate-shaped vibration transmitting member through said vibration receiving plate, whereby vibrations are propagated transversely in an extending direction of the vibration transmitting member.

5. A body-felt vibration unit as in claim 1, wherein the low-frequency current comprises a sound signal.

* * * * *